US010428788B2

(12) United States Patent
Rigolon

(10) Patent No.: US 10,428,788 B2
(45) Date of Patent: Oct. 1, 2019

(54) DEVICE FOR AUTOMATICALLY SWITCHING THE DISPLACEMENT OF A MACHINE WITH AXIAL PISTONS

(71) Applicant: POCLAIN HYDRAULICS INDUSTRIE, Verberie (FR)

(72) Inventor: Enrico Rigolon, Verberie (FR)

(73) Assignee: POCLAIN HYDRAULICS INDUSTRIE, Verberie (FR)

( * ) Notice: Subject to any disclaimer, the term of this patent is extended or adjusted under 35 U.S.C. 154(b) by 594 days.

(21) Appl. No.: 14/973,093

(22) Filed: Dec. 17, 2015

(65) Prior Publication Data

US 2016/0177913 A1 Jun. 23, 2016

(30) Foreign Application Priority Data

Dec. 23, 2014 (FR) ..... 14 63288

(51) Int. Cl.
*F03C 1/40* (2006.01)
*F04B 1/32* (2006.01)

(52) U.S. Cl.
CPC ..... *F03C 1/0678* (2013.01); *F03C 1/0686* (2013.01); *F04B 1/324* (2013.01)

(58) Field of Classification Search
CPC ..... F03C 1/0678; F03C 1/0686; F04B 1/324
USPC ..... 92/12.2
See application file for complete search history.

(56) References Cited

U.S. PATENT DOCUMENTS

2015/0337813 A1* 11/2015 Iwanaji ..... F04B 1/324 417/222.1

FOREIGN PATENT DOCUMENTS

WO WO2014156207 * 1/2014 ..... F04B 1/26

* cited by examiner

*Primary Examiner* — Michael Leslie
*Assistant Examiner* — Daniel S Collins
(74) *Attorney, Agent, or Firm* — Womble Bond Dickinson (US) LLP

(57) ABSTRACT

The invention relates to a device (10) for controlling the displacement of a machine (20) with axial pistons comprising a case (23) that houses a control unit comprising a displacement control spool (110) adapted to be switched between two positions by a control pressure (Ps) according to an axis of sliding (Δ): a working position wherein the control spool (110) provides a connection between at least one inlet (103, 104) that receives a supply pressure and an outlet (105, 106) connected to a cylinder for adjusting the inclination of said machine (31*a*, 31*b*), and an idle position wherein the control spool (110) interrupts the connection between said inlet (102, 104) and said outlet (101, 103), and comprising means for switching adapted to vary the position of the adjusting cylinder (31*a*, 31*b*), a spring (140), characterised in that: said means of communication comprise a second switching spool (130), coaxial to the control spool (110), a switching pressure (Pm) exerts an axial force on the second spool (130) in the direction of the control spool (110), the spring (140) exerts an axial force on the two spools (110, 130), which tends to move them apart from each other, control pressure (Ps) exerts an axial force on the control spool (110) in the direction of the second tool (130).

11 Claims, 14 Drawing Sheets

Section A-A

Section B-B

DEVICE FOR AUTOMATICALLY SWITCHING THE DISPLACEMENT OF A MACHINE WITH AXIAL PISTONS

TECHNICAL FIELD GENERAL

The invention relates to a device for controlling the displacement of a machine with variable displacement axial pistons.

In particular, the invention relates to a device for a machine that makes it possible to automatically switch between a small and a large displacement by a variation in the inclination of a plate, according to certain pressures.

STATE OF THE ART

Figure 2A:
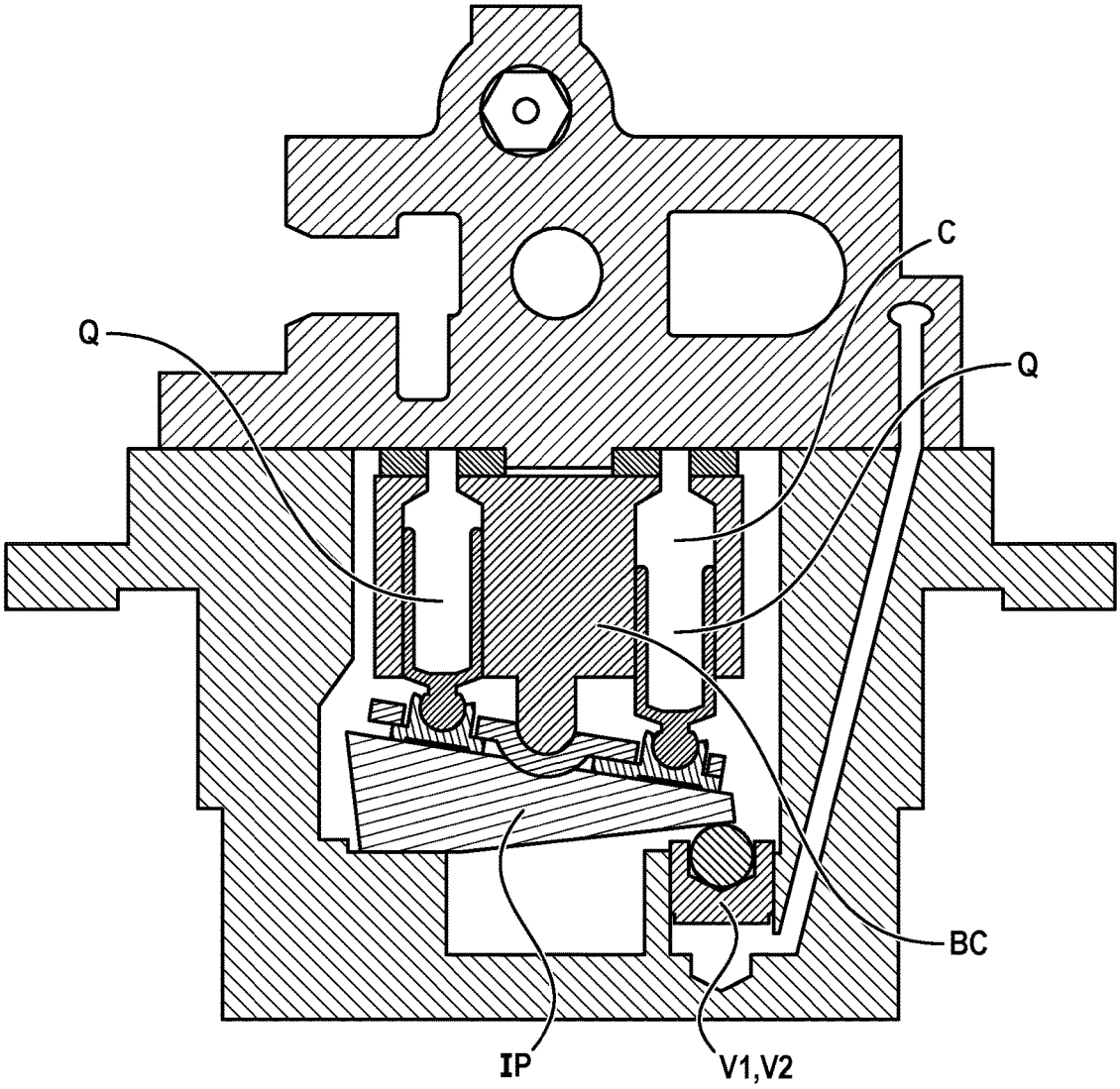
Figure 2B:
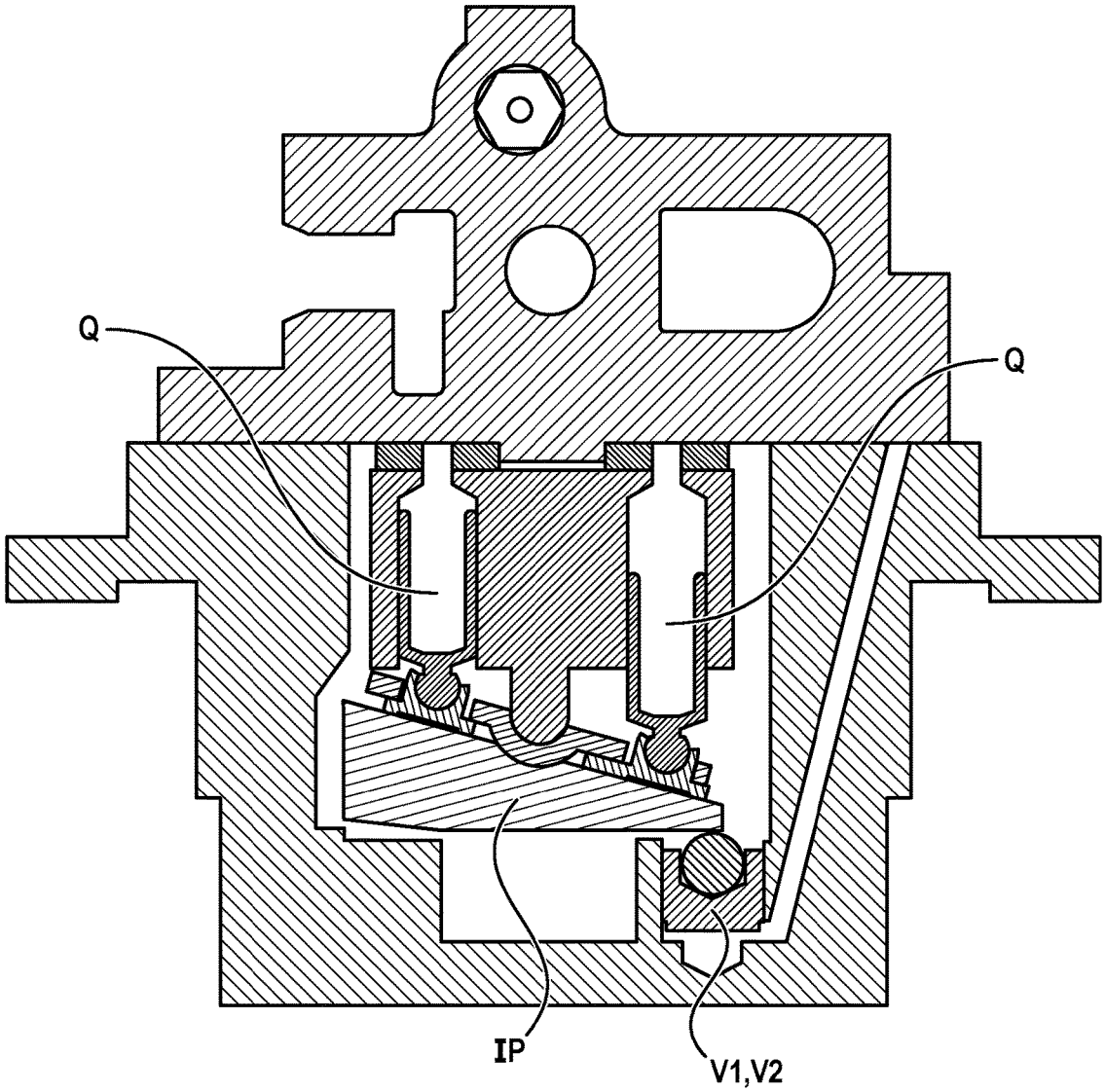

Machines with axial pistons are machines that can operate either as a pump, or as an engine. For this (see FIG. 1), the machine comprises:

- a cylinder block BC comprised of a plurality of cylinders C distributed in a circle about an axis of rotation R-R',
- a series of pistons Q1, Q2, . . . , distributed in a circle about the same axis of rotation R-R', guided to slide axially respectively in the cylinders C of the cylinder block BC and each connected to two intake and exhaust oil ducts,
- an inclinable plate IP, mounted in rotation with respect to the cylinder block BC, which serves as a support at the end of the pistons Q1, Q2, . . . external to the cylinders C, The inclination of the plate is variable in relation to a plane perpendicular to the axis of rotation R-R' thanks to cylinders V1, V2 and makes it possible to adjust the travel of the pistons Q and therefore the displacement (see FIGS. 2*a* and 2*b*, for respectively the small and the large displacement).

The full machine integrates several elements. In a common case that comprises a cover, is located both the pump/engine structure BC, Q1, Q2, with the plate IP, and hydraulic means which make it possible on the one hand to control the arriving and the returning of oil to the pistons Q and on the other hand to control the inclination of the plate IP in order to vary the displacement.

These hydraulic means comprise two separate units S1 (controlling pressures), S2 (controlling of the plate) for these two functions, which use valves and complex connections.

However, these hydraulic means (and its two units) must be integrated into the case and in particular into the cover.

Figure 3:
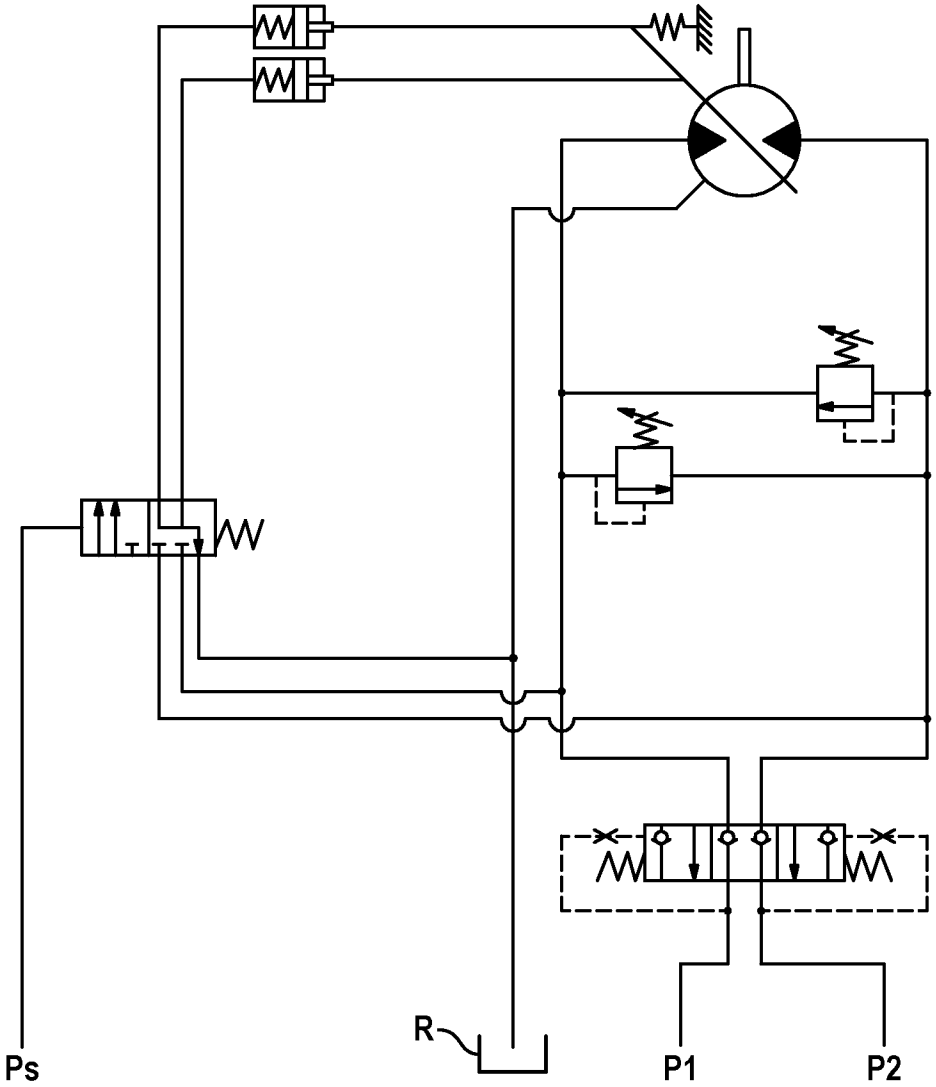

In reference to FIG. 3, the unit S1 typically comprises a four-port, three-position distributor.

As for the unit S2 for controlling the plate, it can be broken down into several embodiments: non-automatic and automatic switching.

Non-automatic Switching

Figure 4B:
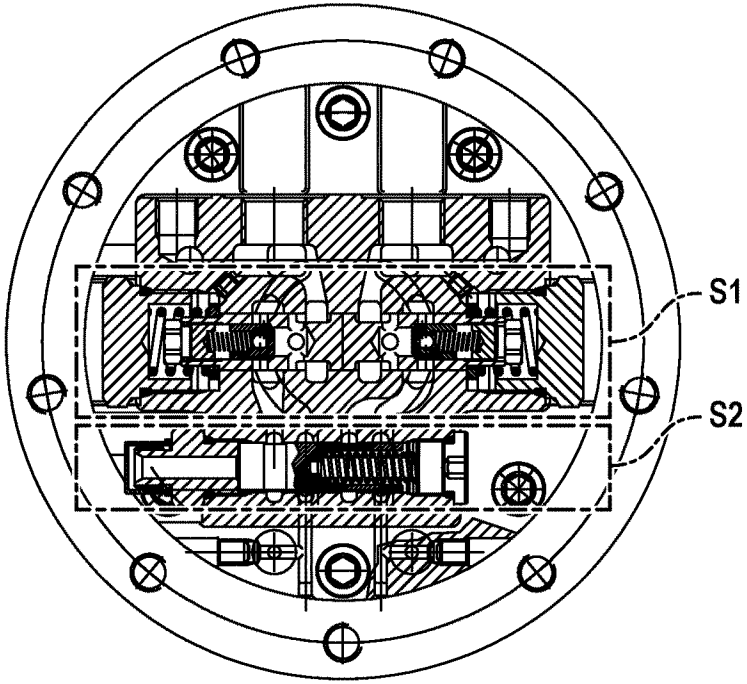
FIG. 4b Prior art
Figure 4A:
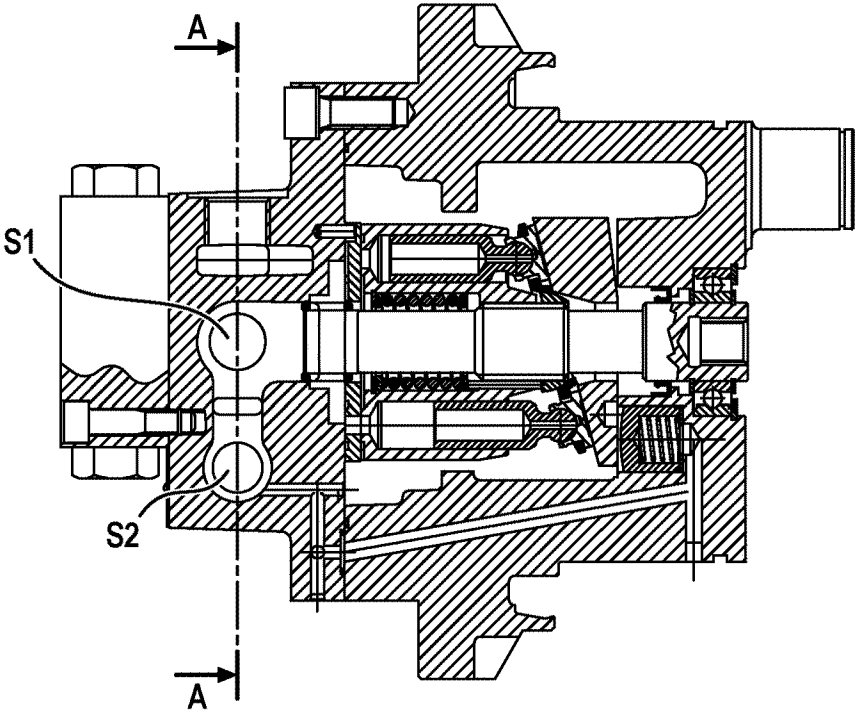
FIG. 4a Prior art
Figure 4C:
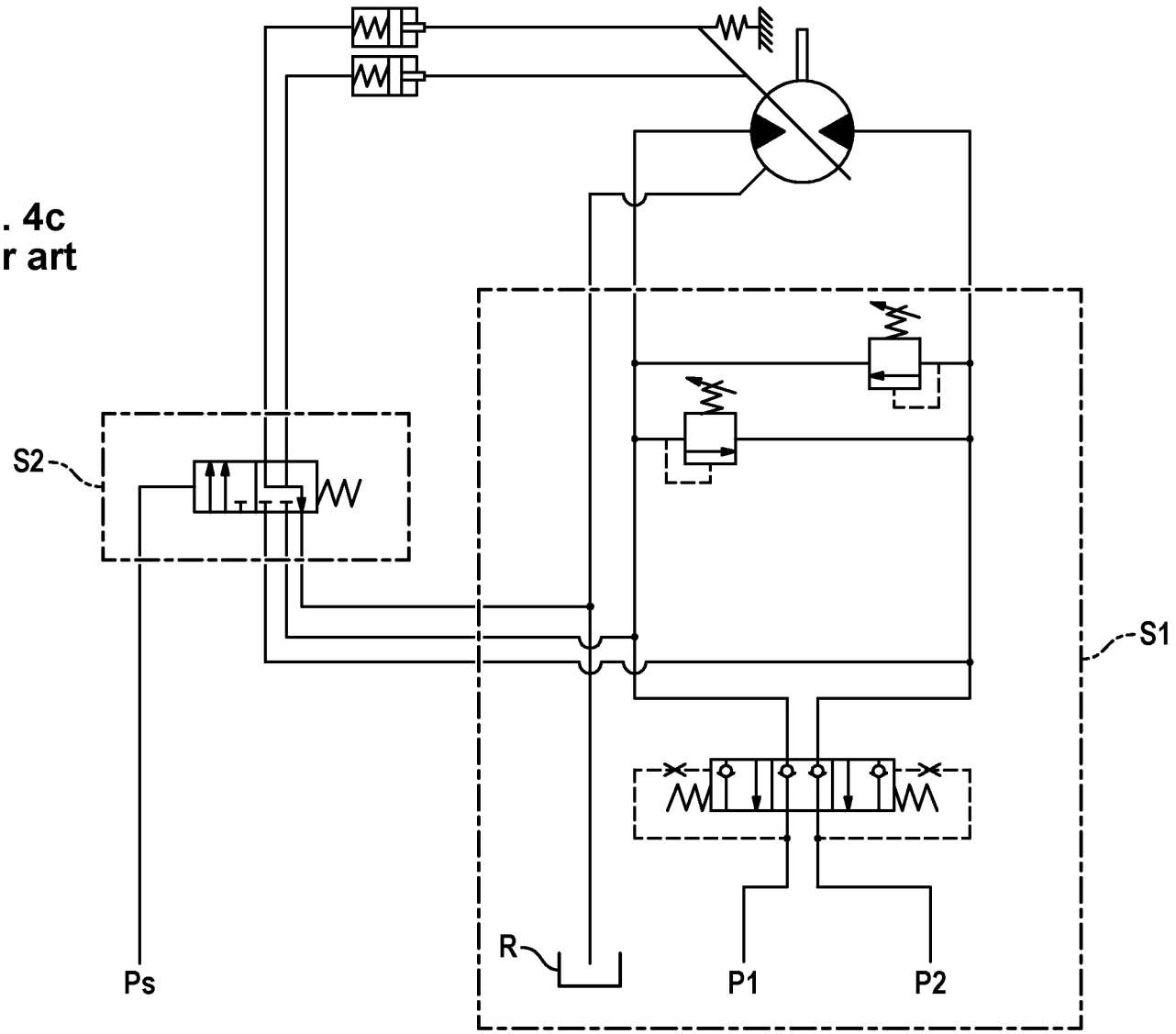
FIG. 4c Prior art
Figure 4D:
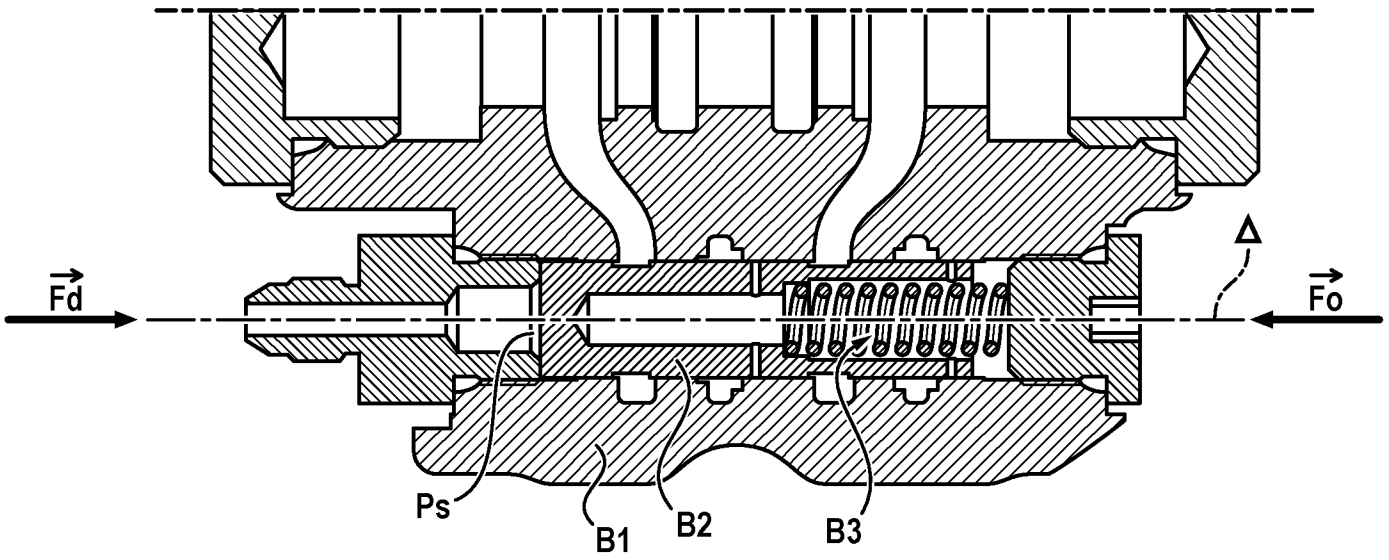
FIG. 4d Prior art

FIGS. 4*a*, 4*b*, 4*c* show respectively a lateral, frontal section and a hydraulic drawing of a machine such as existing in prior art. FIG. 4*d* shows such a system S2 in three dimensions. The systems S1, S2 have been identified in the figures. The two are located in the same plane.

The unit S2 comprises a five-port control valve and two positions which make it possible:

- in a standard position to empty the tilt cylinders, towards the tank for example,
- in a controlled position to supply the tilt cylinders V1, V2 respectively under pressure P1 and P2, according to the direction of operation: one of the lines will be under high pressure and the other will be under low pressure.

The pressures P1 and P2 can be inverted if the machine operates in the reverse direction, or if the machine is in traction or is retained.

The controlling is carried out by a control pressure line Ps that is also independent.

In this embodiment, the controlling is controlled solely by the control pressure line Ps.

In FIG. 4*d*, note a case B1 that houses a control spool B2 that can be switched according to an axis of switching Δ between two positions by a control pressure Ps. A spring B3 opposes the movement of said spool B2. The switching takes place if the force Fd exerted by the oil under pressure Ps is greater than the opposition force Fo of the spring B3.

Automatic Switching

FIGS. 5*a*, 5*b*, 5*c*, 5*d* respectively show a lateral, frontal section and a hydraulic drawing of a machine such as exists in prior art. In this embodiment, the machine comprises an additional automation unit S3. As can be seen in FIG. 4*a*, this unit S3 is not located in the same plane as the others and requires a rather complex adaptation of the architecture in relation to the machine of FIGS. 4*a*, 4*b* and 4*d*.

Document WO 2007/115828 describes such a device.

The unit S3 comprises a two-port valve one position in blocked position by default and controlled by a line that is piloted by the highest pressure of P1 et P2. The valve of the unit S3 comprises a pin, a spool and a spring that the pin can compress by driving the spool in translation. In conditions of light work, the pressure of the engine decreases and the hydraulic load of the oil that acts on the pin is less than the value of the spring. The spool becomes blocking and the circuits of two cylinders are no longer discharged via the unit S3 towards the tank. The pressure in these circuits then increases. The plate is displaced from its maximum displacement configuration to its minimum displacement configuration. Inversely, in difficult working conditions, the hydraulic load increases and the spool does not block. The oil of the cylinder circuits is then unloaded into the tank and the plate recovers its maximum displacement configuration.

Figure 6:
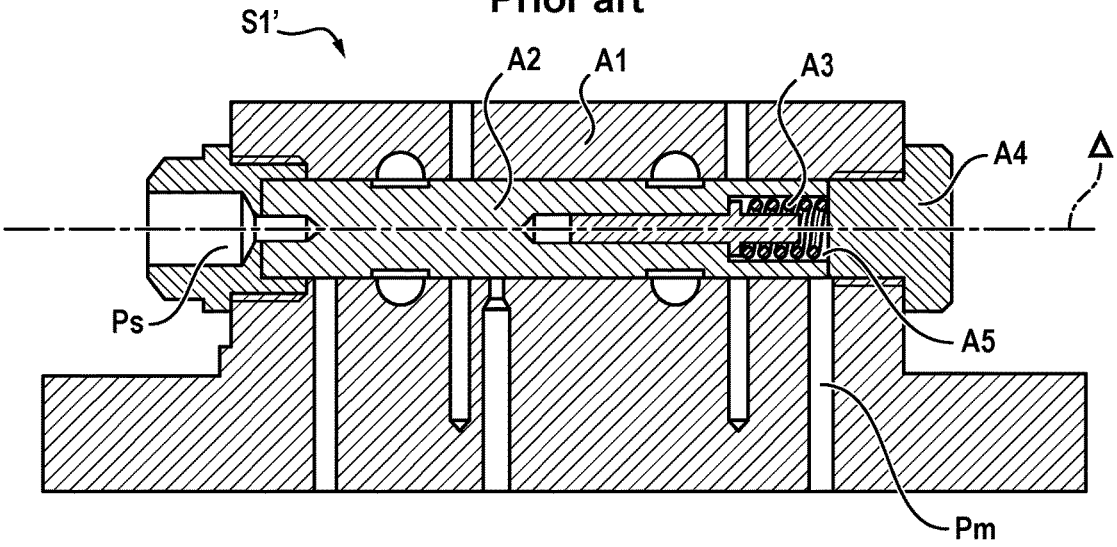
FIG. 6 Prior art

Alternatively, as shown in FIG. 6, document Kayaba JPH01116301 (or published under JP 2654953) has another embodiment S2' of the unit for controlling the plate.

This unit S2' comprises a case A1 that houses a control spool A2 that can be switched according to an axis of switching Δ between two positions by a control pressure Ps:

- a working position wherein the control spool provides a connection between an inlet that receives a supply pressure and an outlet connected to the cylinder V1 (or V2),
- an idle position wherein the control spool A2 interrupts said connection.

The spool A2 is maintained in idle position by a spring A3, connected to an end of the spool A2 and to a plug A4. The spring A3 exerts a force according to the axis Δ which tends to move the spool A2 away from the plug A4. The plug A4 closes the case in a sealed manner.

Furthermore, between the plug A4 and the spool A2 is located a cavity A5 which can receive the oil from the control pressure Ps. The oil under control pressure Ps exerts a force on the spool A2 collinear in the same direction as the spring A3.

The case A1 comprises an inlet of oil under pressure Pm on another end of the spool A2, which can exert a force on the spool, in the direction opposite that of the spring A3 exerted on the spool A2.

In this way, the displacement of the spool A2 depends on the pressures Pm, Ps and on the spring A3. In particular, when the force exerted by the pressure A6 is less than that exerted by the spring A3, the spool A2 is maintained in idle position. When this pressure increases, it makes it possible to displace the spool A2 by compressing the spring A3.

When the switching pressure Pm is activated, the positioning of the spool A2 is carried out automatically according to the value of this switching pressure Pm. However, it is not permitted to obtain a simple correspondence between the position of the spool A2 and the values of the pressures A6 and Ps.

Indeed, when the spring A3 is compressed to the maximum by the pressure Ps, the switching pressure Pm required to displace the spool A2 to its idle position will be less than that required to maintain the spool A2 in its idle position, due to the lengthening of the spring A3, which sees ipso facto its force decrease when its lengthening increases (spring maintained in compression).

This gives rise to problems with controlling the pressure and with adjusting the spool A2.

As such, regardless of the controlling unit S2 described hereinabove, none are fully satisfactory. The first substantially complicates and modifies the architecture of the pump in relation to so-called standard versions, and the second has problems in terms of control.

PRESENTATION OF THE INVENTION

The invention proposes a device for controlling the displacement of a machine with axial pistons comprising a case that houses a control unit comprising:

- A displacement control spool adapted to be switched between two positions by a control pressure according to an axis of sliding:
  - a working position wherein the control spool provides a connection between at least one inlet that receives a supply pressure and an outlet connected to a cylinder for adjusting the inclination of said machine, and
  - an idle position wherein the control spool interrupts the connection between said inlet and said outlet, and
- means for switching adapted to vary the position of the adjusting cylinder,
- a spring, wherein:

- said means of communication comprise a second switching spool, coaxial to the control spool,
- a switching pressure exerts an axial force on the second spool in the direction of the control spool,
- the spring exerts an axial force on the two spools, which tends to move them apart from each other,
- a control pressure exerts an axial force on the control spool in the direction of the second tool.

The invention may also include the following features, taken alone or in combination:

- The control spool comprises at least one circular groove and the spool having two ends,
- The second spool comprises a head and a body, with the head sliding in a plug located on the axis of sliding,
- The axial force of the control pressure is exerted via oil by a control pressure line in a cavity formed by the case and the first end of the piston,
- The spring exerts its force on the body of the second tool and on the second end of the control spool,
- The axial force of the switching pressure is exerted via oil by a switching pressure line in a cavity formed by said plug and the head of the second tool,
- the second end of the control spool comprises a recess wherein the spring is partially housed,
- the body of the second tool is able to come into contact with the second end of the control spool when the spring is compressed inside said recess of the control spool.

The invention also relates to a machine with axial pistons comprising a device as described above, wherein the case comprises:

- a first inlet, a first outlet, a second inlet, a second outlet, the control spool comprises two parallel grooves, wherein in working position, the control spool makes it possible to connect the first inlet to the first outlet via the first gorge and the second inlet to the second outlet via the second groove.

The invention may also include the following features, taken alone or in combination:

- the switching pressure is the supply pressure of the machine,
- the control pressure line comprises a restriction, more preferably an orifice of 0.5 mm in diameter.

At last, the invention also relates to a method for using a device as described above, wherein:

a. If no control pressure is applied, then the control spool is maintained in idle position by the spring, b. If a control pressure is applied then the change in displacement is automatically carried out according to the load applied to the machine, i. If the force exerted by the control pressure is greater than the force exerted by the switching pressure, then the control spool is in working position, ii. If the force exerted by the control pressure is less than the force exerted by the switching pressure, then the control spool is in idle position.

The method may also include the following features, taken alone or in combination:

- when the control spool is in idle, respectively working, position, the machine has a large displacement, respectively small, displacement,
- the control pressure is constant,
- the switching pressure is variable,
- the control pressure is between 20 and 40 bars,
- the switching pressure is between 40 and 250 bars and depends on the load of the machine.

PRESENTATION OF THE FIGURES

Figure 1:
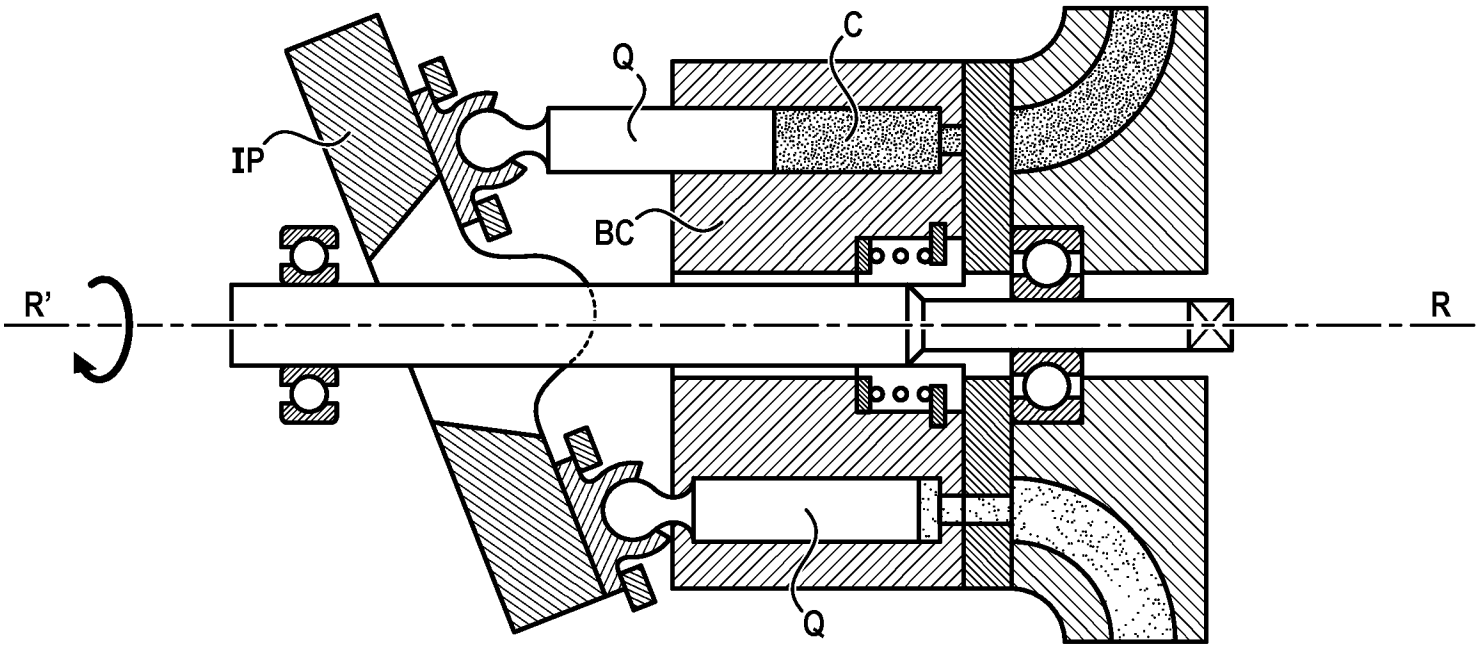
Figure 7:
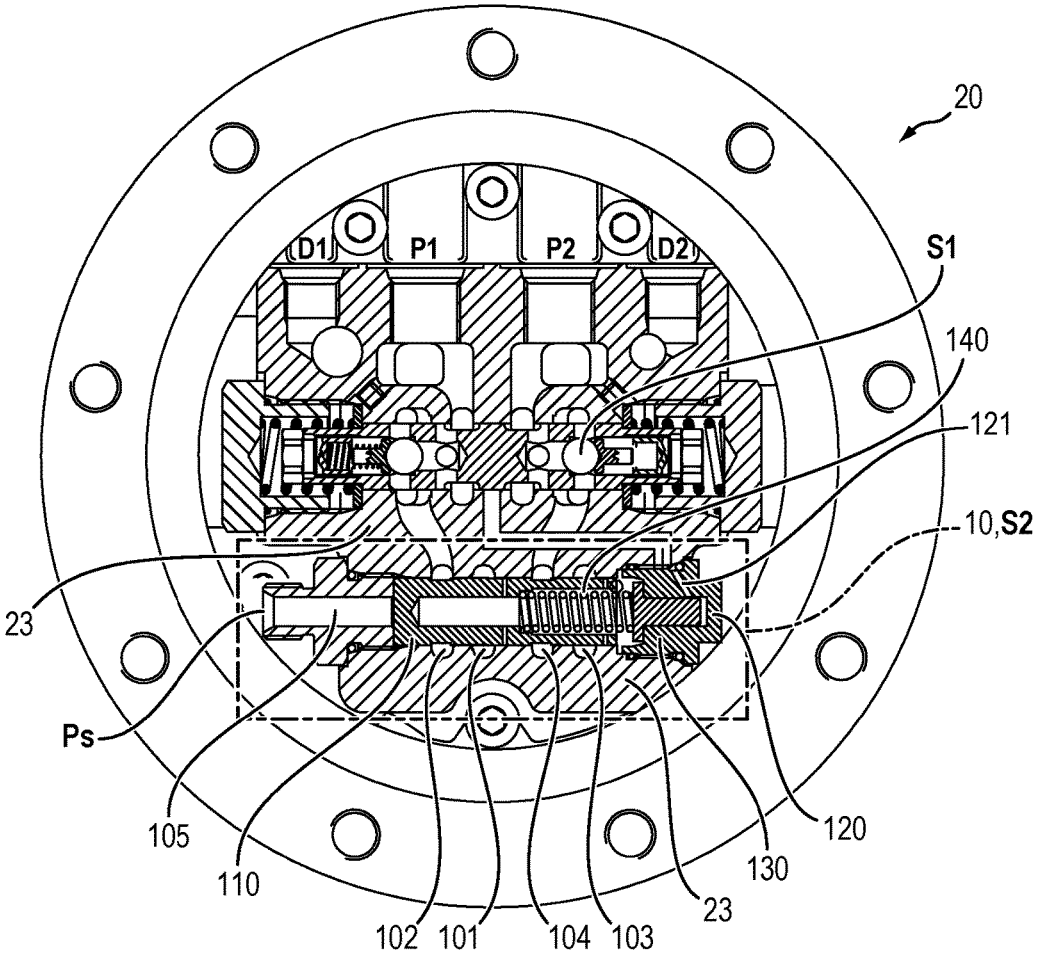
Figure 8:
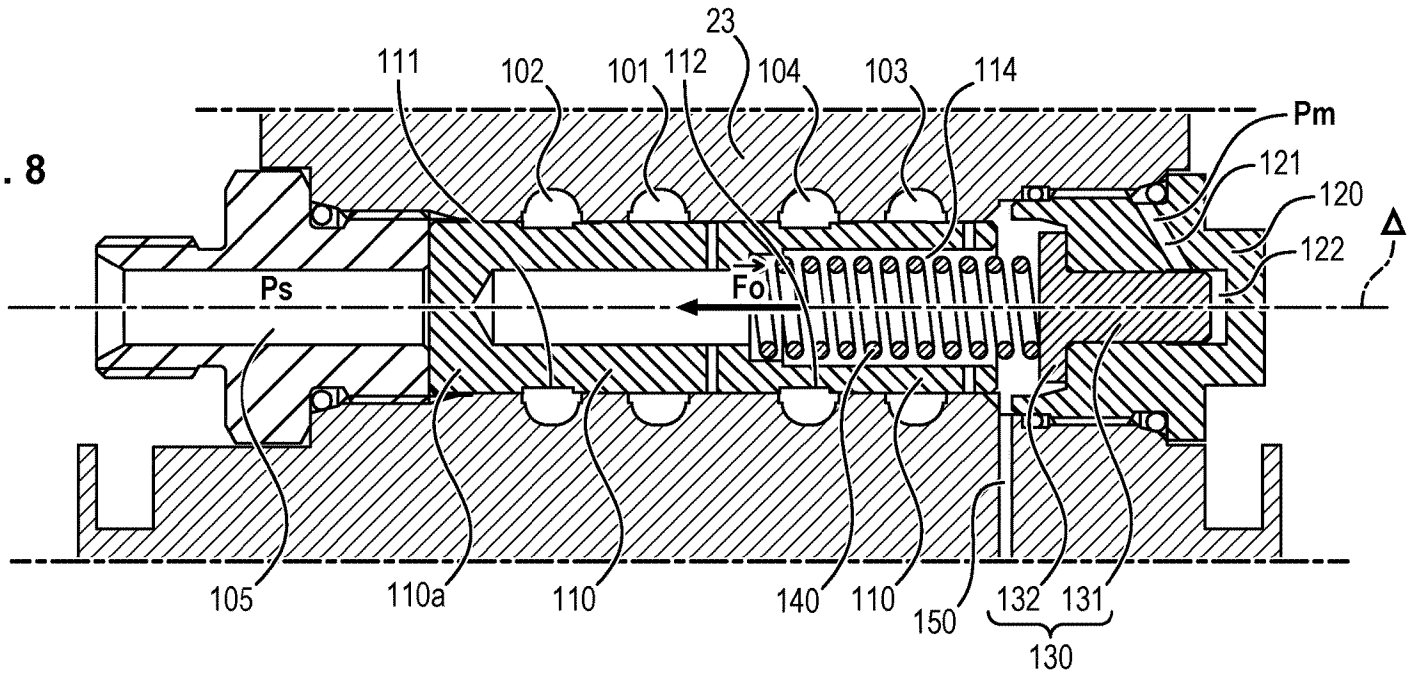
Figure 9:
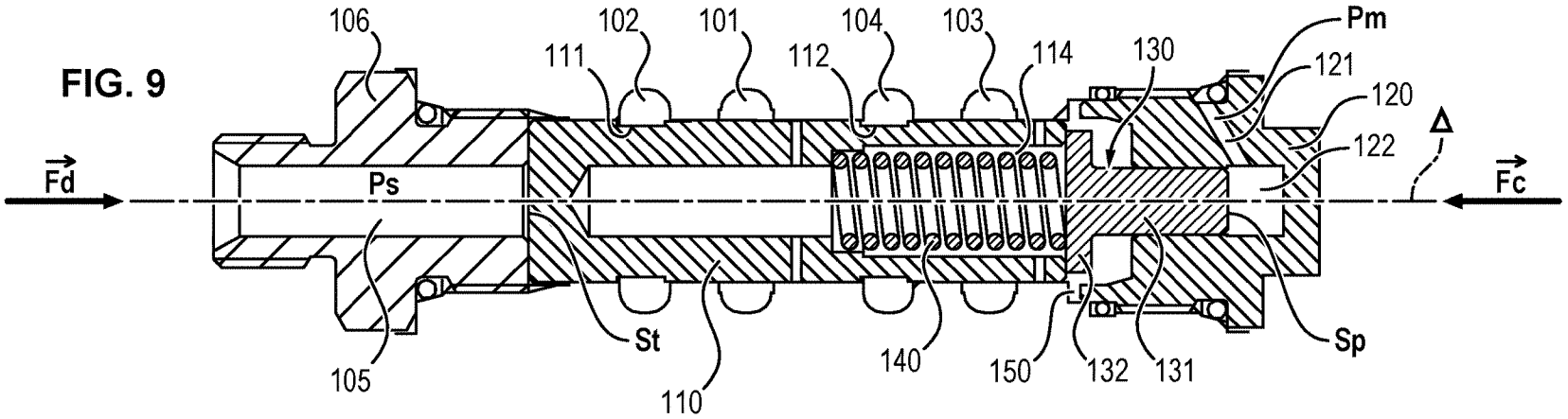
Figure 10A:
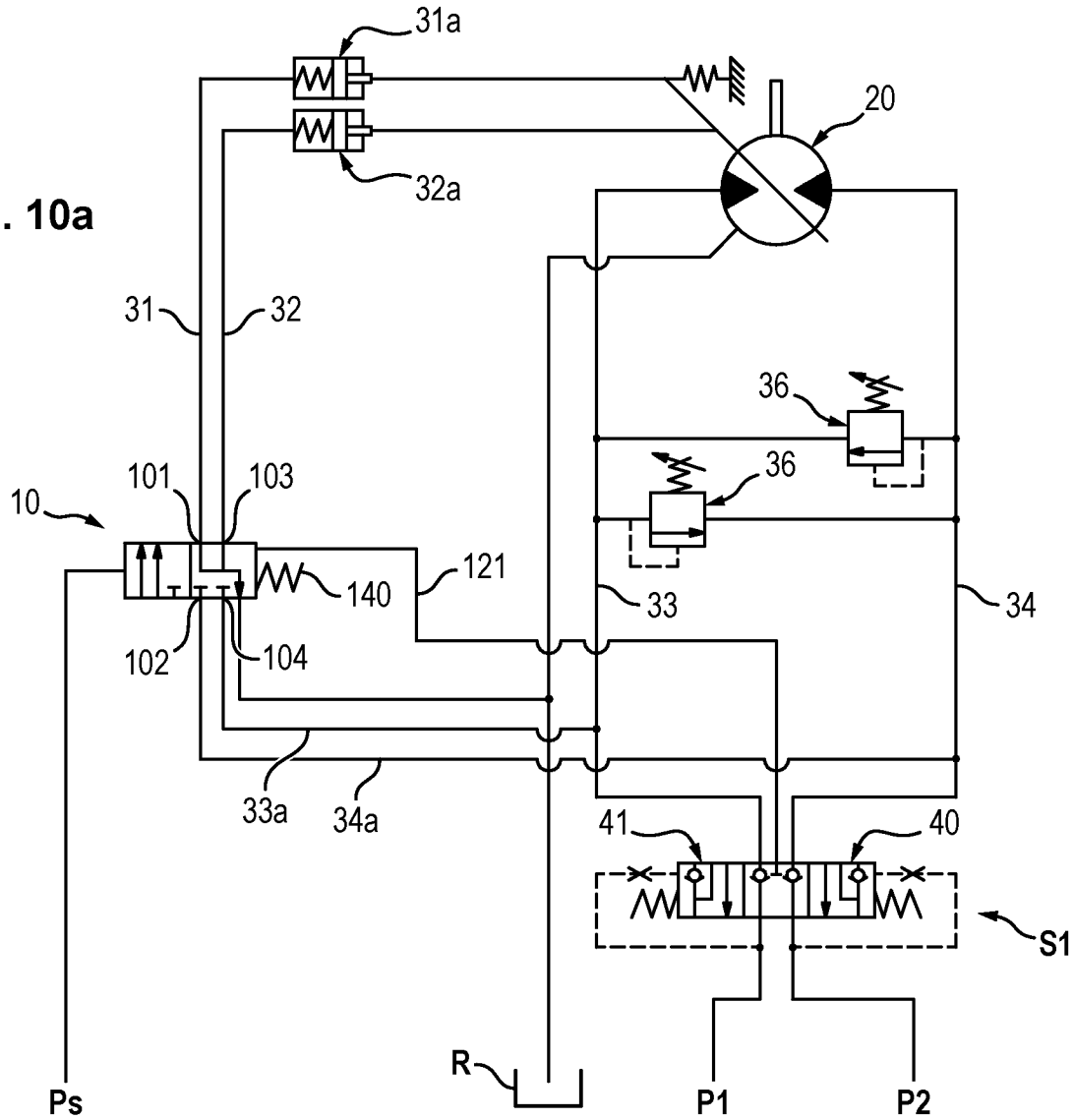
Figure 10B:
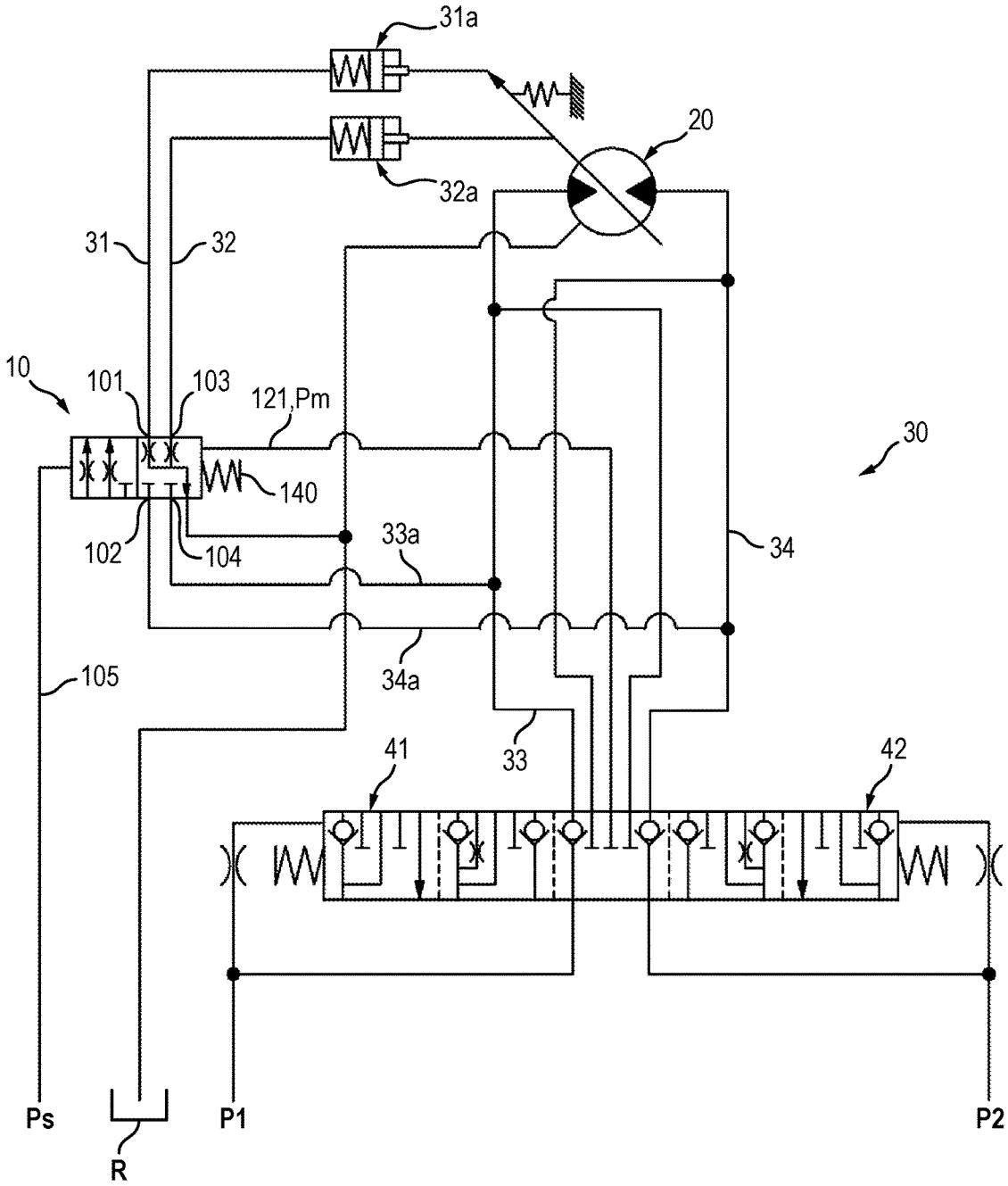
Figure 11A:
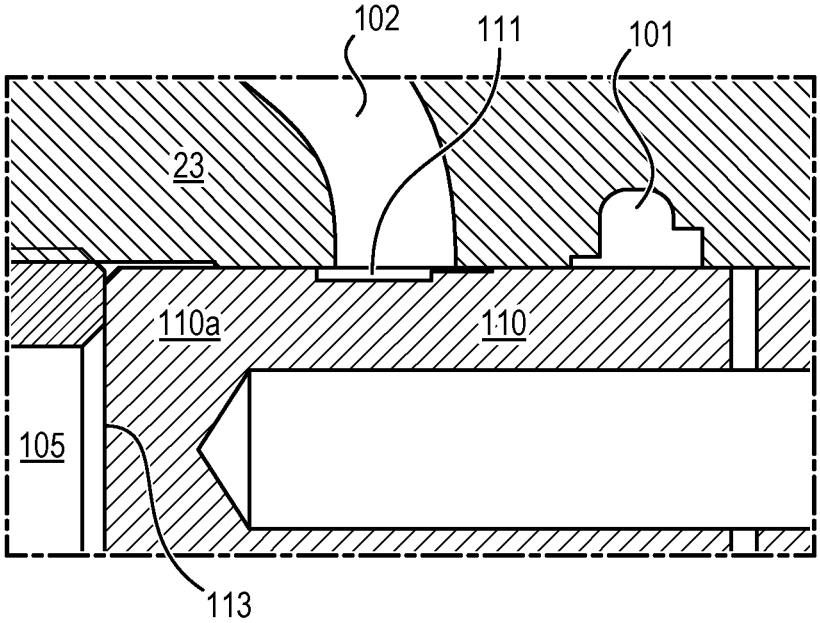
Figure 11B:
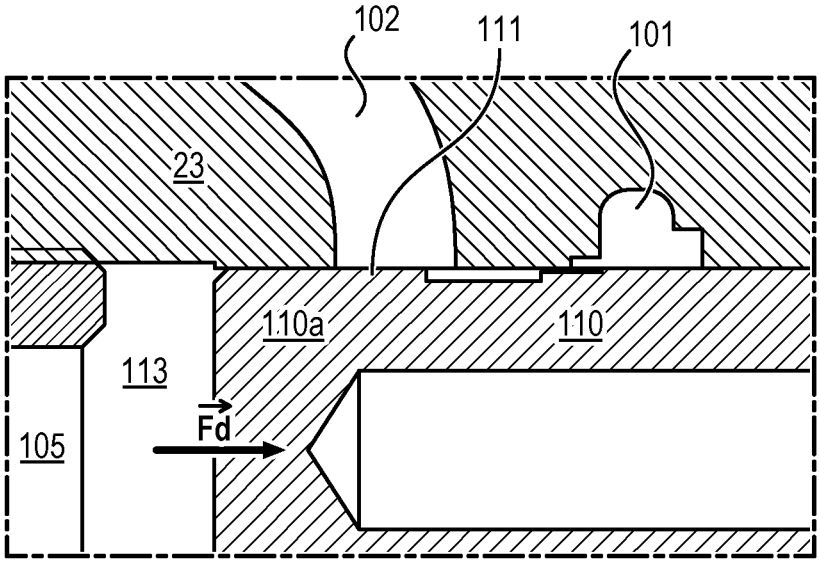

Other characteristics, purposes and advantages of the invention shall appear in the following description, which is purely for the purposes of information and is not restricted, and which must be read in respect to the annexed drawings, wherein:

FIG. 1 shows a machine with variable displacement axial pistons,

FIGS. 2*a*, 2*b* show the plate according to two states (respectively small and large displacement), FIG. 3 shows an hydraulic drawing of a machine that exists in the prior art, FIGS. 4*a* to 4*c* respectively show a lateral, frontal section and a hydraulic drawing of a machine that exists in prior art, FIG. 4*d* shows a control unit in accordance with the prior art of FIGS. 3*a* to 3*c*, FIGS. 5*a*, 5*b*, 5*c*, 5*d* respectively show a lateral, frontal section and a hydraulic drawing of a machine such as exists in prior art according to another embodiment, FIG. 6 shows a control unit of prior art, according to another embodiment, FIG. 7 shows a machine with a device in accordance with one of the embodiments of the invention, FIGS. 8 and 9 show an enlarged view of the device of the invention in two different position, FIGS. 10*a*, 10*b* show two embodiments of hydraulic drawings of the circuit and of the pressure control unit, FIGS. 11*a*, 11*b* show the spool respectively in idle and working position.

DETAILED DESCRIPTION

In reference to FIGS. 7, 8, 9 and 10*a*, 10*b* an embodiment of the invention shall be described.

The device 10 is a unit for controlling the plate S2, integrated into a machine with variable displacement axial pistons 20 through inclination of the plate. The device 10 is a selector arranged in a hydraulic circuit 30 (see FIG. 10*a*, 10*b*), with the circuit being substantially similar to that described in the introduction (cf. EP 2 592 263). The hydraulic circuit 30 comprises a first cylinder line 31 and a second cylinder line 32, connected respectively to the cylinders 31*a* and 32*a* which allow for the inclination of the plate 21 according to the pressures to which they are subjected.

The device 1 has two positions: in an idle position, the two cylinder lines 31, 32 are emptied, in a working position, the two cylinder lines 31, 32 are pressurised.

A first supply line 33 connects a unit S1 for controlling the pressures to the pistons of the machine 20 and a second supply line 34 connects the pistons of the machine 20 to the unit S1. It is specified that the roles can be inverted according to the direction of operation of the machine (forward movement or backward movement). The supply lines 33, 34 are supplied at pressures P1, P2. A unit S1 for controlling pressures distributes the pressures P1, P2 in the supply lines 33, 34. According to the use (engine, pump, forward movement, backward movement), each line 33, 34 can bring or recover the oil, at high or low pressure.

The device 10 is typically housed in a case 23 of the machine 20, with the case comprising a first outlet 101, a second outlet 103, a first inlet 102, a second inlet 104 (see FIGS. 11*a*, 11*b*). The first outlet 101 of the case 23 is connected to the first cylinder line 31 and the second outlet 102 is connected to the second cylinder line 32.

Note that the device 10 functions in a similar manner with a single inlet and outlet instead of two inlets and outlets 101, 102, 103, 104.

The device 10 for controlling the displacement of a machine 20 with axial pistons therefore comprises the case 23 that houses a control unit S1 comprising:

- A displacement control spool 110 adapted to be switched between two positions by a control pressure Ps according to an axis of sliding Δ:
  - an idle position (FIG. 11*a*) wherein the control spool 110 interrupts the connection between said inlet 102, 104 and said outlet 101, 103, and
  - a working position (FIG. 11*b*) wherein the control spool 110 provides a connection between at least one inlet 102, 104 that receives a supply pressure and an outlet 101, 103 connected to a cylinder for adjusting the inclination of said machine 31*a*, 31*b*, and
- means for switching adapted to vary the position of the adjusting cylinder (31*a*, 31*b*),
- a spring 140.

These different elements are arranged in the following way:

- said means of communication comprise:
  - a second switching spool 130, coaxial to the control spool 110,
  - a switching pressure Pm that exerts an axial force on the second spool 130 in the direction of the control spool 110,
- the spring 140 exerts an axial force on the two spools 110, 130 which tend to move them apart from each other,
- a control pressure Ps exerts an axial force on the control spool 110 in the direction of the second tool 130.

More precisely, the control spool 110 has two ends 110*a*, 110*b*. The control spool 110 comprises at least one circular groove 111, 112, and preferably as mentioned hereinabove a first groove 111 that connects the first inlet 102 to the first outlet 101 and a second groove 112 that connects the second inlet 104 to the second outlet 103.

The second spool 130 comprises a head 131 and a body 132, with the head sliding in a plug 120 located on the axis of sliding Δ.

The axial force of the control pressure Ps is exerted via oil by a control pressure line 105 in a cavity formed by the case 23 and the first end of the piston 110*a*. The spring 140 exerts its force on the body 132 of the second tool 130 and on the second end of the control spool 110. This control pressure line 105 is typically of an on/off mode, that is to say that it is alternatively applied a pressure Ps or no pressure.

The control pressure line 105 can comprise a restriction, more preferably an orifice of 0.5 mm in diameter.

The axial force of the switching pressure Pm is exerted via oil by a switching pressure line 121 in a cavity 122 formed by said plug 120 and the head 131 of the second tool 130. The switching pressure line 121 is located in said plug 120.

In the case where there are two inlets and outlets 101, 102, 103, 104, the first supply line 33 is tapped by a first sampling 33*a* in order to supply the first inlet 102 and the second supply line 34 is tapped by a second sampling 34*a* in order to supply the second inlet 104.

The case 23 guides the control spool 110. The first end 110*a* of the control spool 110 and the case 23 form a cavity 113, of variable size according to the position of the control spool 110. The displacement pressure line 105 supplies said cavity 113 with oil under control pressure Ps. Preferably, when automatic mode is activated, the control pressure Ps is constant. In addition, it is typically comprised between 20 and 40 bars. In this way, the device 10 is such that the oil under pressure exerts a displacement force Fd on the control spool 110 according to the axis of sliding Δ, in the direction of the second tool 130.

Alternatively, the pressure Ps can be adjusted by the user in order to configure the operation of the machine.

As mentioned hereinabove, the communication between the inlets 102, 104 and outlets 101, 103 respectively is carried out by the two circular grooves 111, 112 (see FIGS. 8, 9 and 11*a* for the idle position, and FIG. 11*b* for the working position—only the groove 111 is shown) drawn on the control spool 110 when the cavity 113 is subjected to the control pressure Ps. These grooves 111, 112 also have the function of a flow limiter.

The second spool 130 slides in the plug 120 according to the axis of sliding Δ, which means that the displacements of the control spool 110 and of the second tool 130 are collinear. The plug 120 thus guides the second spool 130. The head 131 and the plug 120 form a cavity 122, of variable size according to the position of the second tool 130. The switching pressure line 121 supplies said cavity 122 with oil under switching pressure Pm. The switching pressure Pm typically corresponds to one of the supply pressures P1, P2 of the machine 20. It is therefore variable according to the load of the machine 20. It is typically between 40 and 250 bars.

In this way, the device 10 is such that the oil under switching pressure Pm in the cavity 122 exerts a counteracting force Fc on the head 131 of the second tool 130 according to the axis of sliding Δ, in the direction of the control spool 110.

The spring 140, as mentioned hereinabove, is located between the second end 110*b* of the control spool 110 and the body 132 of the second tool 130. Through the architecture of the device 10, the spring 140 exerts thrust forces (it is constantly in compression).

The spring 140 is in an oil bath. For this, a drainage circuit 150 makes it possible to supply the zone of the spring 140 with oil.

According to a preferred embodiment, the second end 110*b* of the control spool 110 comprises a recess 114 in which the spring 140 is partially housed (see FIGS. 8 and 9 in particular). Furthermore, the body 132 of the second tool 130 is able to come into contact with the second end 110*b* when the spring 140 is compressed inside said recess 114 of the control spool 110. For this, the diameter of the body 132 of the second tool 130 is for example greater than or equal to the diameter of the second end 110*b*.

The drainage circuit 150 opens into the recess 114.

Except therefore in abutment, the second end 110*b* of the control spool 110 is therefore not in direct contact with the second tool 130.

Alternatively (not shown in the figures), the second end 110*b* of the control spool 110 cannot come into contact with the body 132 of the second tool 130: either the spring having a stiffness such that the displacement force Fd and the counteracting force Fc cannot compress it enough, or because its volume of material prevents the contact when it is fully compressed.

The displacement force Fd is equal to the product of the control pressure Ps of the oil in the displacement pressure line 105 with the area St of the section whereon the control pressure Ps is exerted, i.e. typically the section of the first end 110*a* of the spool 110: $Fd=Ps\times St$.

Similarly, the counteracting force Fc is equal to the product of the switching pressure Pm of the oil in the switching pressure line 121 with the area Sp of the section whereon the control pressure Ps is exerted, i.e. the section of the head 131 of second spool 130: $Fc=Pm\times Sp$.

By the arrangement of the elements described hereinabove, recall that the displacement force Fd and the counteracting force Fc are therefore exerted in the opposite direction.

The spring 140, as for it, opposes the displacements of the control spool 110 and of the second tool 130. Considering a fixed second spool 130 immobile, the spring therefore exerts its opposition force Fo (said force being equal to the product of its stiffness and of its difference in length with its length when empty) in the direction opposite that of the displacement force Fd. Considering a fixed control spool 110, the spring 140 therefore exerts its opposition force Fo in the direction contrary to that of the counteracting force Fc.

For all practical purposes, recall that the opposition force of the spring Fo on a part depends on the position of the part located on the other side, since this position has an influence on the length of the compressed spring 140.

The stiffness of the spring 140 and/or the control pressure Ps is chosen (according to the active surface of the mobile part) in such a way that the value of the minimum opposition force Fo is less than the displacement force Fd.

When the second spool 130 is in abutment in the plug 120, i.e. that the cavity 122 of the plug 120 is of minimum size, and that the displacement pressure line 105 does not supply the cavity 113 with oil under control pressure Ps, the spring 140 maintains the control spool 110 in idle position (i.e. the cavity 113 of the case 23 is of minimum size).

More generally, regardless of the positions of the control spool 110 and of the second tool 130, as long as the displacement force Fd is less than the opposition force Fo, the control spool 110 is maintained in idle position by the spring 140, as shown in FIG. 8.

Note that if the cavity 122 of the plug 120 is at switching pressure Pm, the control spool 110 is a fortiori maintained in this idle position, as can be seen in FIG. 9.

On the other hand, when the cavity 113 is supplied with oil under control pressure Ps, the control spool 110 can be put in the two positions without the length of the spring 140 changing. For this, the control pressure Ps must be able to generate a displacement force Fd that is higher than the maximum opposition force Fo, which is that obtained when the cavity 122 has a maximum volume, which is that of the spring that is the most strongly compressed.

Two cases are obtained:

If the displacement force Fd is greater than the counteracting force Fc, then the control spool 110 is in working position, If the displacement force Fd is less than the counteracting force Fc, then the control spool 110 is in idle position, More precise details on the state of the spring 140 in these cases shall now be provided.

According to a first embodiment (preferred) of the spring 140 and of the second end 110*b* of the control spool 110: with the control spool 110 assumed to be in working position, i.e. $Fd>Fo$, Fc is then applied on the second spool, with $Fc>Fo$. In this case, the spring 140 will be compressed until the body 132 of the second tool 130 is in contact with the second end 110*b* of the control spool 110. This is then two solid parts in contact, and the displacement is made in one direction or the other according to the value of the forces: the characteristics of the different elements (the control pressure Ps, the stiffness of the spring 140, choice of surfaces, etc.) are chosen during design in such a way that Fc can be greater than Fd, in this way the control spool 110 passes into idle position. Inversely, the spool 110 passes back into working position, when the switching pressure Pm decreases and satisfies $Fc<Fd$. The decrease in the switching pressure Pm is linked to the load of the machine 20 (increasing, decreasing, intense use, etc.).

According to another embodiment of the spring 140: the control spool 110 is assumed to be in working position, i.e. $Fd>Fo$, Fc is then applied on the second spool, with $Fc>Fo$. In this case, the spring 140 will be compressed until $Fo=Fc$ (or reach its mechanical limit, i.e. its maximum physical compression, and in this case the spring behaves like a solid part and we also have $Fo=Fc$). The characteristics of the different elements (the control pressure Ps, stiffness of the spring 140, choice of surfaces etc.) are chosen during the design in such a way that Fc (then equal to Fo) can be higher than Fd, in this way, on a $Fc=Fo>Fd$, and therefore the control spool 110 passes to idle position. Inversely, the spool 110 passes back into working position when the switching pressure Pm decreases and satisfies $Fc=Fo<Fd$.

In the two cases consequently, when automatic mode is activated (i.e. the line 105 is brought to the pressure Ps, which enables activating Fd that opposes to Fc), the controlling of the control spool 110 is controlled by the algebraic value Fd-Fc, and the value of the force Fo of the spring 130 no longer intervenes, contrary to prior art of Kayaba described in the introduction.

More concretely, the adding of a second spool 120 means that the spring exerts its force of each side on a different spool that each one is mobile and displaced by the oil pressure. Consequently, the two opposing forces exerted by the spring offset each other.

In the same compact and structurally close device solutions without automatic mode, a device is obtained with non-automatic mode which takes full advantage of the spring in order to maintain the device 10 in idle position and an automatic mode which makes it possible to overcome the spring in order to switch between the idle position and the working position according to solely the control Ps and switching Pm pressures.

In relation with the hydraulic circuit 30, when the device 10 is in working position, the first sampling 33*a* is connected to the first cylinder line 31 via the first inlet 102, the groove 111 and the high pressure outlet 101, in order to allow for the activation of the cylinder 31*a*. In the idle position, the cylinder lines 31, 32 are no longer supplied with oil under pressure. In this position, cylinder lines 31, 32 are both connected to an emptying line.

In idle position, respectively working position, the machine 20 is said to have a large displacement, respectively small displacement.

When the auto shift mode is activated (i.e. the line 105 is brought to the pressure Ps):

- with zero or low-intensity use, the supply lines 33, 34 of the machine 20 have a low load and the switching pressure Pm, which is one of the supply pressures P1, P2 of the machine 20, is low. In this way, the spool 110 is in working position and the cylinder supply lines 31, 32 are supplied with oil under pressure. The machine is then in small displacement.
- with high-intensity use, the supply lines 33, 34 of the machine 20 have a substantial load and the pressure Pm is high. In this way, the spool 110 is pushed into idle position and the lines 31, 32 are no longer supplied with oil under pressure and are emptied towards the tank. The engine is then in large displacement.

Two embodiments of the unit S1 are now given.

In a first embodiment (FIG. 10*a*), the unit S1 comprises a five-port, three-position distributor 40. The distributor 40 receives the supply lines 33, 34 as well as the control pressure line Pm. This distributor 40 makes it possible either:

- in an empty position, to apply the pressure P1 in the first supply line 33 and the pressure P2 in the second supply line 34 in a position, the first supply line 33 and the switching pressure line 121 are brought to the pressure P1, the second supply line 34 then serving for exhaust for the hydraulic machine 20,
- in another position, the second supply line 34 and the switching pressure line 121 are brought to the pressure P2, with the first supply line 33 then serving for exhaust.

The distributor 40 integrates non-return valves 41 in the direction of the supply lines 33, 34 of the machine 20.

In this embodiment, the circuit 30 can comprise at least two pressure limiters 36 between the two supply lines 33, 34, in two different directions.

In a second embodiment (FIG. 10*b*) the unit S1 comprises a six-port, five-position distributor 42. The supply lines 33, 34 are divided and are each connected to two ports of the distributor 42.

Three of the positions are similar in function to the preceding distributor 40.

Except for the switching line 121, document EP 2 592 263 describes one this unit S1.

In the two additional positions:

- the distributor 42 connects one of the two ports of the first supply line 33 to the pressure P1 (with a non-return valve 41) and one of the two ports of the second supply line 34 to the pressure P1 also, with a flow limiter, or
- the distributor 42 connects the other of the two ports of the second supply line 34 to the pressure P2 (with a non-return valve 41) and the other of the two ports of the first supply line 34 to the pressure P2, with a flow limiter.

Figure 5B:
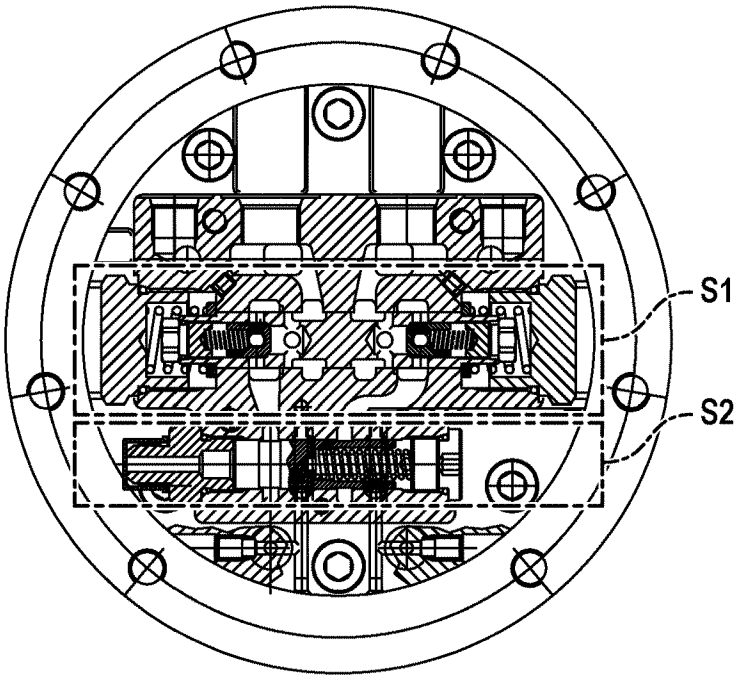
FIG. 5b Prior art
Figure 5A:
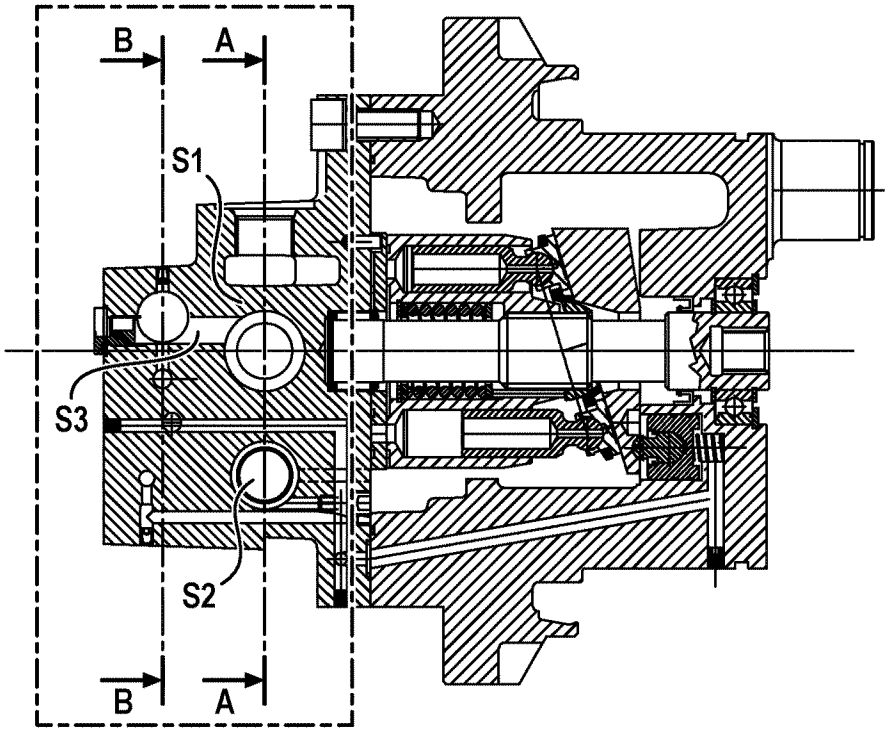
FIG. 5a Prior art
Figure 5D:
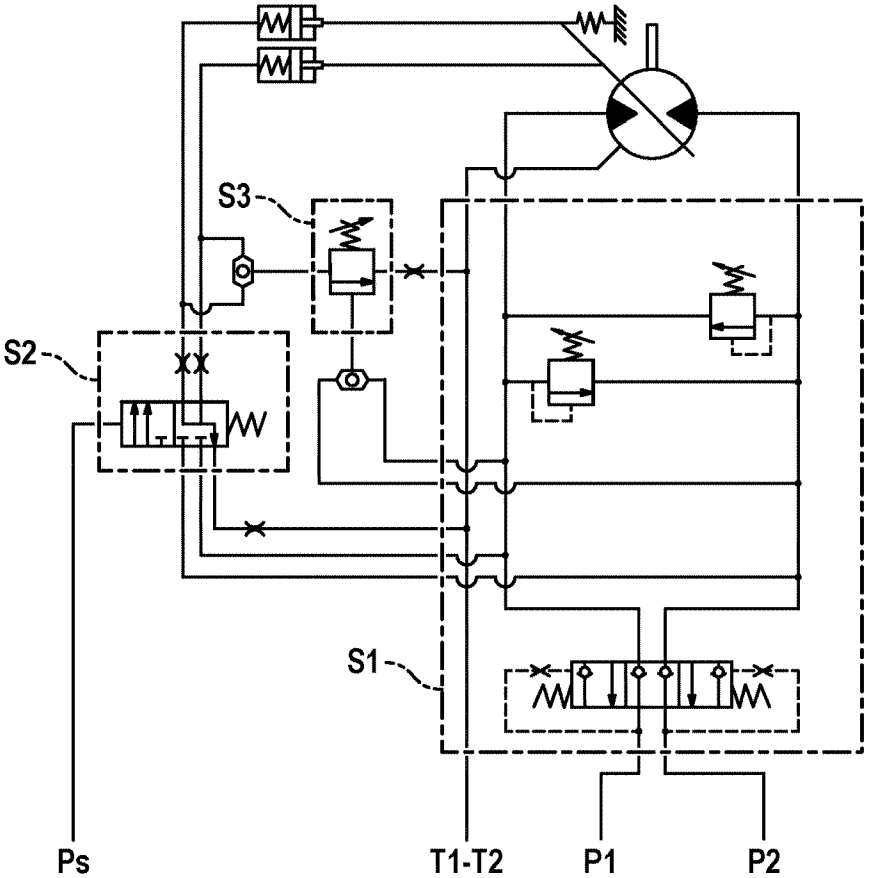
FIG. 5d Prior art
Figure 5C:
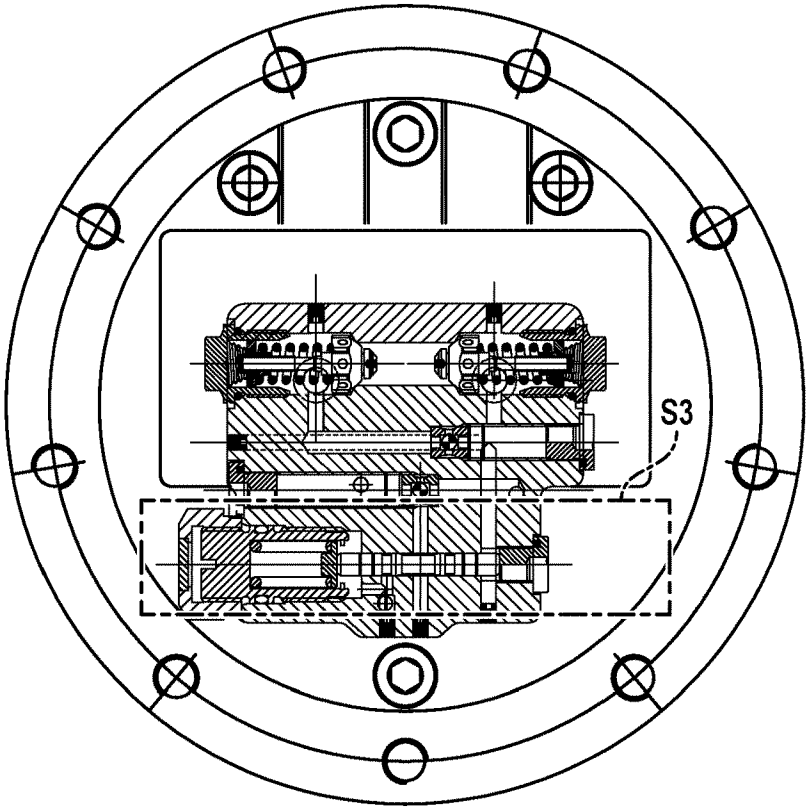
FIG. 5c Prior art

By comparing the architecture of the device 10 in relation to the solution of prior art without automatic mode (FIG. 4*d* vs. FIG. 8), note that the architecture remains similar, contrary to the first prior art described (different elements in several planes, cf. FIGS. 5*a* to 5*c*). Indeed, the control spool 110, the spring 140, the arrival of the displacement pressure line 105, the case 23 on the first end 11*a* side of the control spool 110 are unchanged. The plug 120 and the second spool 130 are indeed new but can be adapted to standard elements.

Finally, with regards to the case 23 of the machine 20, the latter simple requires a modification in the vicinity of the plug 120 and of the second spool 130.

The invention claimed is:

1. Device (10) for controlling the displacement of a machine (20) with axial pistons comprising a case (23) that houses a control unit comprising:

- A displacement control spool (110) adapted to be switched between two positions by a control pressure (Ps) according to an axis of sliding (Δ):
  - a working position wherein the control spool (110) provides a connection between at least one inlet (103, 104) that receives a supply pressure and an outlet (105, 106) connected to a cylinder for adjusting the inclination of said machine (31*a*, 31*b*), and
  - an idle position wherein the control spool (110) interrupts the connection between said inlet (102, 104) and said outlet (101, 103), and
- means for switching adapted to vary the position of the adjusting cylinder (31*a*, 31*b*),
- a spring (140), characterised in that:

- said means of communication comprise a second switching spool (130), coaxial to the control spool (110),
- a switching pressure (Pm) exerts an axial force on the second spool (130) in the direction of the control spool (110),
- the spring (140) exerts an axial force on the two spools (110, 130), which tends to move them apart from each other,
- a control pressure (Ps) exerts an axial force on the control spool (110) in the direction of the second tool (130), and
- wherein a second end (110*b*) of the control spool (110) comprises a recess (114) wherein the spring (140) is partially housed.

2. Device according to claim 1, wherein

- The control spool (110) comprises at least one circular groove (111, 112) and the spool having two ends (110*a*, 110*b*),
- The second spool (130) comprises a head (131) and a body (132), with the head sliding in a plug (120) located on the axis of sliding (Δ),
- The axial force of the control pressure (Ps) is exerted via oil by a control pressure line (105) in a cavity formed by the case (23) and the first end of the piston (110*a*), The spring (140) exerts its force on the body (132) of the second tool (130) and on the second end of the control spool (110), The axial force of the switching pressure (Pm) is exerted via oil by a switching pressure line (121) in a cavity (122) formed by said plug (120) and the head (131) of the second tool (130).

3. Device according to claim 1, wherein the body (132) of the second tool (130) is able to come into contact with the second end (110*b*) of the control spool (110) when the spring (140) is compressed inside said recess (114) of the control spool (110).

4. Method for using a device according to claim 1, wherein:

a. If no control pressure (Ps) is applied, then the control spool (110) is maintained in idle position by the spring (140), b. If a control pressure (Ps) is applied then the change in displacement is automatically carried out according to the load applied to the machine (20)

i. If the force exerted by the control pressure (Ps) is greater than the force exerted by the switching pressure (Pm), then the control spool (110) is in working position, ii. If the force exerted by the control pressure (Ps) is less than the force exerted by the switching pressure (Pm), then the control spool (110) is in idle position.

5. Method for using according to claim 4, wherein when the control spool (110) is in idle, respectively working, position, the machine (20) has a large displacement, respectively small, displacement.

6. Method for using according to claim 4, wherein the control pressure (Ps) is constant.

7. Method for using according to claim 4 wherein the switching pressure (Pm) is variable.

8. Method for using according to claim 4, wherein:

the control pressure (Ps) is between 20 and 40 bars.

the switching pressure (Pm) is between 40 and 250 bars and depends on the load of the machine (20).

9. Device (10) for controlling the displacement of a machine (20) with axial pistons comprising a case (23) that houses a control unit comprising:

A displacement control spool (110) adapted to be switched between two positions by a control pressure (Ps) according to an axis of sliding (Δ):

a working position wherein the control spool (110) provides a connection between at least one inlet (103, 104) that receives a supply pressure and an outlet (105, 106) connected to a cylinder for adjusting the inclination of said machine (31*a*, 31*b*), and an idle position wherein the control spool (110) interrupts the connection between said inlet (102, 104) and said outlet (101, 103), and means for switching adapted to vary the position of the adjusting cylinder (31*a*, 31*b*), a spring (140), characterised in that:

said means of communication comprise a second switching spool (130), coaxial to the control spool (110), a switching pressure (Pm) exerts an axial force on the second spool (130) in the direction of the control spool (110), the spring (140) exerts an axial force on the two spools (110, 130), which tends to move them apart from each other, a control pressure (Ps) exerts an axial force on the control spool (110) in the direction of the second tool (130), and wherein the case comprises:

a first inlet (102), a first outlet (101), a second inlet (104), a second outlet (103), and the control spool (110) comprises two parallel grooves (111, 112), wherein in working position, the control spool (110) makes it possible to connect the first inlet (102) to the first outlet (101) via the first gorge (111) and the second inlet (104) to the second outlet (103) via the second groove (112).

10. Machine with axial pistons according to claim 9 characterised in that the control pressure line (105) comprises a restriction, more preferably an orifice of 0.5 mm in diameter.

11. Device (10) for controlling the displacement of a machine (20) with axial pistons comprising a case (23) that houses a control unit comprising:

A displacement control spool (110) adapted to be switched between two positions by a control pressure (Ps) according to an axis of sliding (Δ):

a working position wherein the control spool (110) provides a connection between at least one inlet (103, 104) that receives a supply pressure and an outlet (105, 106) connected to a cylinder for adjusting the inclination of said machine (31*a*, 31*b*), and an idle position wherein the control spool (110) interrupts the connection between said inlet (102, 104) and said outlet (101, 103), and means for switching adapted to vary the position of the adjusting cylinder (31*a*, 31*b*), a spring (140), characterised in that:

said means of communication comprise a second switching spool (130), coaxial to the control spool (110), a switching pressure (Pm) exerts an axial force on the second spool (130) in the direction of the control spool (110), the spring (140) exerts an axial force on the two spools (110, 130), which tends to move them apart from each other, a control pressure (Ps) exerts an axial force on the control spool (110) in the direction of the second tool (130), and wherein the case comprises:

a first inlet (102), a first outlet (101), a second inlet (104), a second outlet (103), and the control spool (110) comprises two parallel grooves (111, 112), wherein in working position, the control spool (110) makes it possible to connect the first inlet (102) to the first outlet (101) via the first gorge (111) and the second inlet (104) to the second outlet (103) via the second groove (112), and wherein the switching pressure (Pm) is the supply pressure (P1, P2) of the machine.

* * * * *